US012359553B2

(12) United States Patent
Chanpura et al.

(10) Patent No.: US 12,359,553 B2
(45) Date of Patent: Jul. 15, 2025

(54) SERVICE IMPROVEMENTS USING ADAPTIVE MODELS DERIVED FROM CLASSIFIED VIBRATION MECHANISMS

(71) Applicant: Halliburton Energy Services, Inc., Houston, TX (US)

(72) Inventors: Reena Agarwal Chanpura, Houston, TX (US); Ketan C. Bhaidasna, Houston, TX (US); Jeremy Greenwood, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 82 days.

(21) Appl. No.: 17/512,457

(22) Filed: Oct. 27, 2021

(65) Prior Publication Data

US 2023/0131106 A1 Apr. 27, 2023

(51) Int. Cl.
*E21B 47/00* (2012.01)
*E21B 44/00* (2006.01)

(52) U.S. Cl.
CPC ..... *E21B 47/00* (2013.01); *E21B 44/00* (2013.01); *E21B 2200/20* (2020.05)

(58) Field of Classification Search
CPC ..... E21B 47/00; E21B 2200/20; E21B 44/00; E21B 2200/22
See application file for complete search history.

(56) References Cited

U.S. PATENT DOCUMENTS 8,214,188 B2 * 7/2012 Bailey ..... E21B 7/00 702/6
9,008,972 B2 * 4/2015 Imhof ..... G01V 1/307 702/13

(Continued)

FOREIGN PATENT DOCUMENTS

CN 108952681 A * 12/2018
CN 115234220 A * 10/2022

(Continued)

OTHER PUBLICATIONS

Matheus, et al.; "A Medical-Inspired Framework to Classify Downhole Shocks Waveforms While Drilling"; IADC; Society of Petroleum Engineers; SPE/IADC-204098-MS; International Drilling Conference and Exhibitation; Mar. 2021; 13 pgs.

*Primary Examiner* — Daniel P Stephenson
(74) *Attorney, Agent, or Firm* — Benjamin Ford; Parker Justiss, P.C.

(57) ABSTRACT

The disclosure provides a solution to problems associated with vibrations during drilling by applying metrics on post job data and providing inputs from past experiences to pre-job planning for drilling jobs. The vibration information and analysis can also be used during a current drilling operation wherein a vibration source can be automatically identified and operating parameters can be changed to mitigate the vibration. The disclosure provides a method of executing a drilling operation, a vibration analyzer, and a drilling system. In one example, the method includes: (1) collecting drilling job data from a completed drilling job, wherein the drilling job data includes sensor data collected from downhole sensors, (2) determining a vibration severity index from the sensor data, and (3) executing at least a portion of a drilling operation based on the vibration severity index.

20 Claims, 5 Drawing Sheets

(56) References Cited

U.S. PATENT DOCUMENTS

| | | | | |
|---|---|---|---|---|
| 10,480,304 | B2 * | 11/2019 | Mauldin | E21B 44/00 |
| 10,597,981 | B2 * | 3/2020 | Urdaneta | E21B 7/00 |
| 11,156,996 | B2 * | 10/2021 | Schuster | G06N 5/04 |
| 2006/0195307 | A1 * | 8/2006 | Huang | E21B 44/00 703/7 |
| 2010/0082256 | A1 | 4/2010 | Mauldin et al. | |
| 2012/0130693 | A1 * | 5/2012 | Ertas | E21B 44/00 703/2 |
| 2013/0282342 | A1 | 10/2013 | Bailey et al. | |
| 2014/0070956 | A1 | 3/2014 | Winkler et al. | |
| 2016/0115778 | A1 | 4/2016 | van Oort et al. | |
| 2017/0183940 | A1 | 6/2017 | Bailey et al. | |
| 2017/0268324 | A1 | 9/2017 | Moore | |
| 2020/0263522 | A1 | 8/2020 | Liu et al. | |
| 2021/0047909 | A1 * | 2/2021 | Bailey | E21B 47/04 |
| 2021/0198997 | A1 | 7/2021 | Moore et al. | |
| 2021/0233008 | A1 * | 7/2021 | Gupta | G06F 16/355 |
| 2021/0246766 | A1 * | 8/2021 | Wilson, III | G06Q 10/06393 |
| 2021/0270120 | A1 * | 9/2021 | Hohl | E21B 49/003 |
| 2022/0121790 | A1 * | 4/2022 | Chen | E21B 47/00 |

FOREIGN PATENT DOCUMENTS

| | | | | |
|---|---|---|---|---|
| EP | 3236384 | A1 * | 10/2017 | E21B 7/00 |
| EP | 2462475 | B1 | 2/2019 | |
| NO | 20200831 | A1 | 7/2020 | |
| WO | WO-2020214170 | A1 * | 10/2020 | E21B 47/00 |

* cited by examiner

400

| MECHANISM (410) | MODE OF VIBRATION (420) | EXPECTED FREQUENCY RANGE (430) |
|---|---|---|
| Stick-Slip/Low-Frequency Torsional Oscillation (LFTO) | Torsional | 0.1-5 Hz |
| Torsional Resonance/High-Frequency Torsional Oscillation (HFTO) | Torsional | 10-800 Hz |
| Bit Bounce | Axial | 1-10 Hz |
| Bit Forward Whirl | Lateral-Torsional | 0.5-5 Hz |
| Bit Backward Whirl | Lateral-Torsional | 10-50 Hz |
| BHA Forward Whirl | Lateral-Torsional | 0.5-5 Hz |
| BHA Backward Whirl | Lateral-Torsional | 5-20 Hz |
| Lateral Shocks | Lateral | Irregular Impacts |
| Parametric Resonance | Axial-Lateral | 0.1-10 Hz |
| BHA Harmonic Resonance | Lateral | 0.5-5 Hz |
| Bit Chatter | Lateral-Torsional | 20-250 Hz |
| Stabilizer Contact Chatter | Lateral | 10-50 Hz |
| Modal Coupling | Lateral-Torsional and Axial | 0.1-20 Hz |

FIG. 4

SERVICE IMPROVEMENTS USING ADAPTIVE MODELS DERIVED FROM CLASSIFIED VIBRATION MECHANISMS

BACKGROUND

Accessing hydrocarbon reserves, such as gas or oil reserves, typically involves creating a wellbore by drilling into the earth using a drill bit. The drill bit is part of a bottom hole assembly (BHA) located at the downhole end of a drill string, which includes multiple drill pipes connected together. In addition to the drill bit, the BHA includes other components, such as stabilizers, drill collars, measuring equipment or sensors, and directional drilling equipment. A top drive is used at the surface of the wellbore to turn the drill string, which rotates the drill bit and extends the wellbore into the earth. A key driver that impacts drilling performance is the severity and the types of vibrations encountered by the BHA and other downhole tools during the drilling job.

SUMMARY

In one aspect, the disclosure provides a method of executing a drilling operation. In one example, the method includes: (1) collecting drilling job data from a completed drilling job, wherein the drilling job data includes sensor data collected from downhole sensors, (2) determining a vibration severity index from the sensor data, and (3) executing at least a portion of a drilling operation based on the vibration severity index.

In another aspect, the disclosure provides a vibration analyzer. In one example, the vibration analyzer includes: (1) a memory having drilling job data from at least one drilling job, wherein the drilling job data includes sensor data from the drilling job, and (2) a processor configured to generate vibration information from sensor data, generate a data set from a data lake of the drilling job data and the vibration information, extract at least one adaptive model from the data set, and use the at least one adaptive model to execute a drilling operation.

In yet another aspect, the disclosure provides a drilling system. In one example, the drilling system includes: (1) multiple downhole tools; and (2) a processor configured to direct operation of at least one of the multiple downhole tools for a drilling operation based on at least one adaptive model extracted from a data set based on a data lake, wherein the data lake includes drilling job data from a completed drilling job and vibration information generated from the completed drilling job.

BRIEF DESCRIPTION

Reference is now made to the following descriptions taken in conjunction with the accompanying drawings, in which:

FIG. 4 illustrates an example of a vibration mechanism index of a data set generated from a data reservoir according to the principles of the disclosure.

DETAILED DESCRIPTION

The disclosure recognizes that the impact of the vibrations from drilling can be correlated to particular components associated with the drilling job, such as the configuration of the BHA, type of formation being drilled, and drilling parameters being used for the drilling job. As such, the disclosure provides a system and method that classifies vibrations and then uses the vibration classifications for design of service (DOS), such as BHA design, drill bit selection, or drilling parameters to be used during drilling. The disclosure provides a solution to problems associated with vibrations during drilling by applying metrics on post job data and providing inputs from past experiences to pre-job planning for drilling jobs. The disclosed system and method collates downhole sensor data in conjunction with other job related data and uses physics or data based on vibration modes, severity, and statistical indexes to associate DOS recommendations and provide efficacy to DOS from a vibration standpoint. As such, the design of tools and services, such as determining the BHA configuration that will give best performance within a region, can be improved. This can result in reduced non-productive time. Valid designs of tools and services can also be verified for future use. Accordingly, components of service design for a drilling operation can be selected in view of vibration information from a previous drilling job or jobs.

For example, drilling engineers may design a service for a drilling job based on certain components requested by a customer. Multiple types of the components can be available for use and can be selected based on the vibration information determined. Considering gamma rays sensors as an example, there may be three or four different kinds to choose from but maybe one of them is causing more vibrations in the particular region of the drilling operation. As such, another gamma ray sensor can be selected for the drilling operation. Additionally, one particular gamma ray sensor may introduce fewer vibrations in the particular region and combined with other components for the drilling operation. As such, this particular gamma ray sensor may be selected for the drilling operation based on the vibration information.

Figure 1:
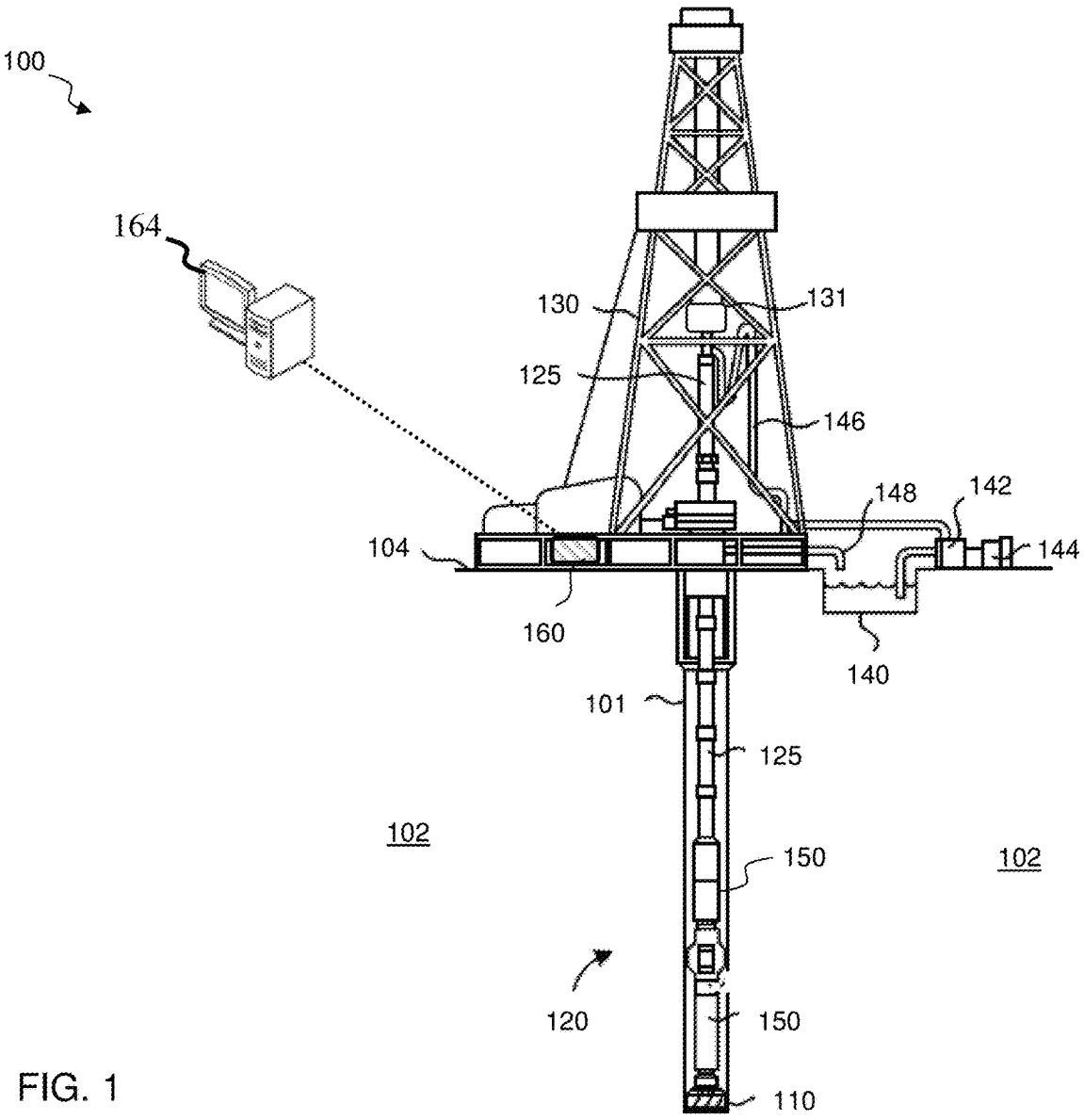
FIG. 1 illustrates a system diagram of an example of a drilling system configured to perform formation drilling to create a wellbore according to the principles of the disclosure.
Figure 2:
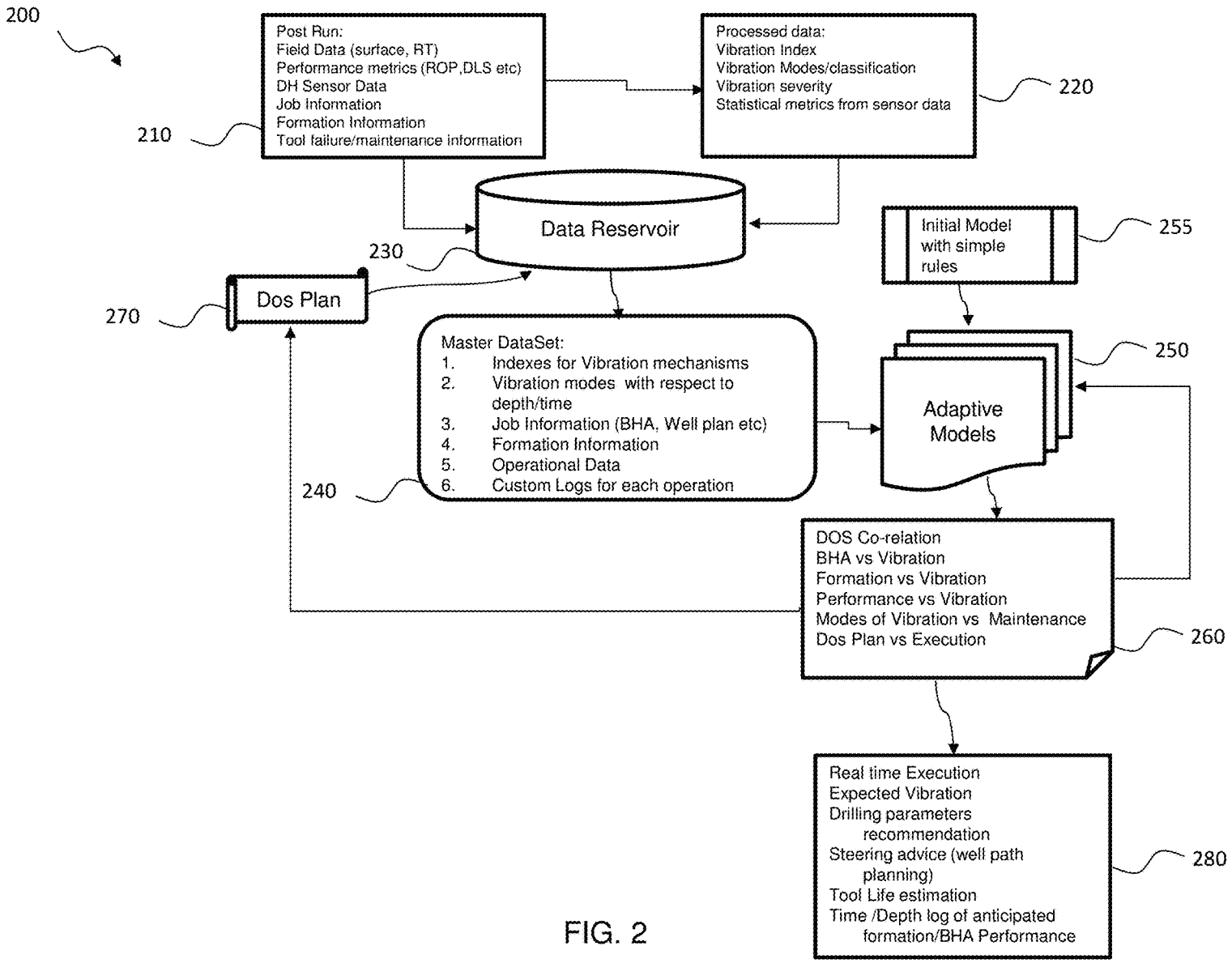
FIG. 2 illustrates a flow diagram of an example of a method of executing a drilling operation carried out according to the principles of the disclosure.
Figure 3:
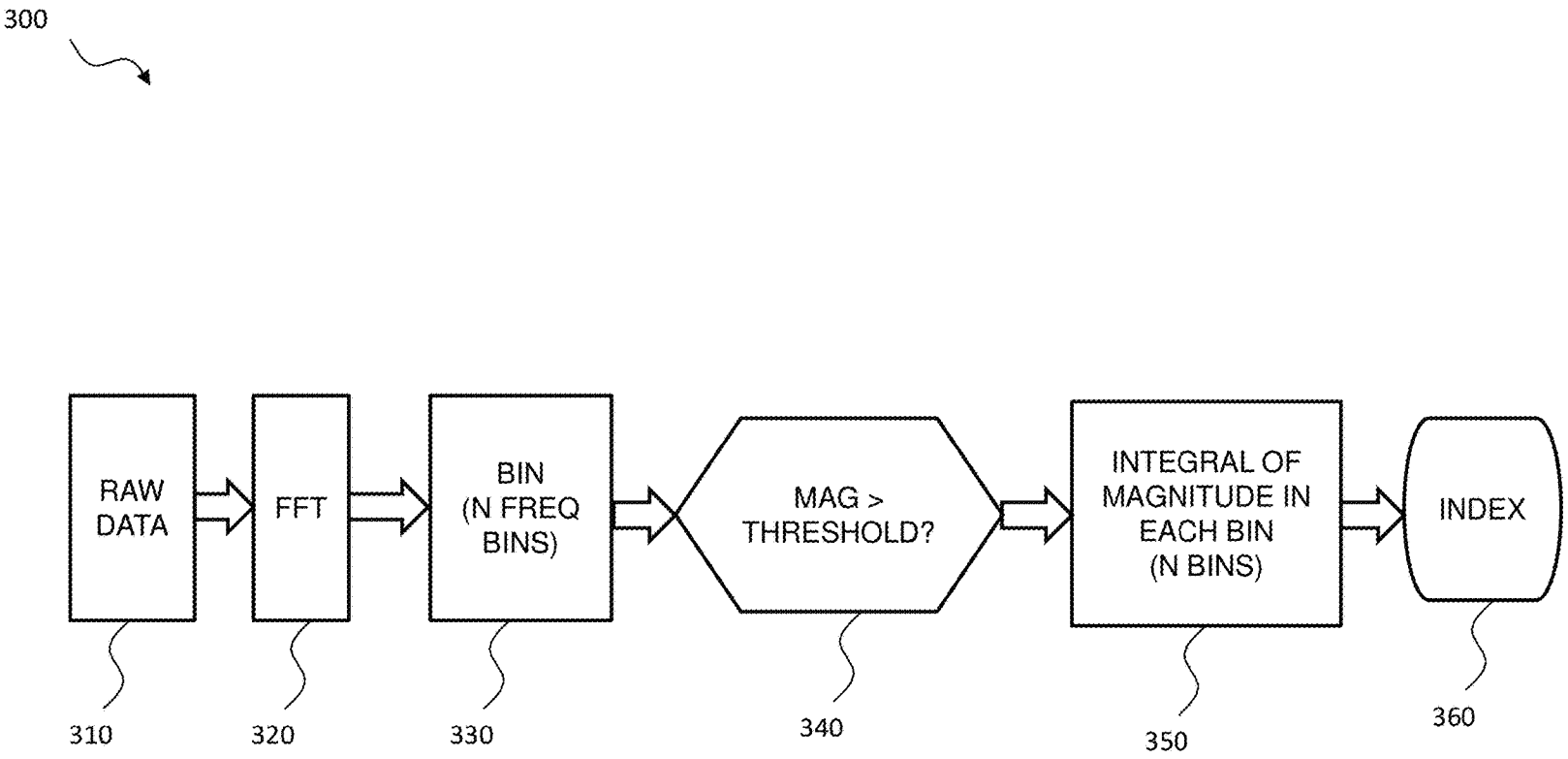
FIG. 3 illustrates a flow diagram of an example of a method for determining a vibration severity index carried out according to the principles of the disclosure.

The logic for one example of using vibration information from one or more completed drilling jobs for another drilling operation as disclosed herein is illustrated in the flow diagrams of FIG. 2 and FIG. 3. The logic can represent algorithms and can reside in a computing system and/or vibration analyzer such as mentioned in FIG. 1 and represented in FIG. 5. The logic can be implemented as a computer program product having a series of operating instructions stored on a non-transitory computer-readable medium that directs a data processing apparatus when executed thereby to perform operations. In addition to post well processing, algorithms can be encoded into a tool for dynamic analysis and operational changes.

FIG. 1 illustrates a drilling system 100 configured to perform formation drilling to create a wellbore 101. The system 100 can be, for example, a logging-while-drilling (LWD) system or a measurement-while-drilling (MWD) system. FIG. 1 depicts an onshore operation. Those skilled in the art will understand that the disclosure is equally well suited for use in offshore operations or onshore operations over a body of water. The system 100 includes a BHA 120 that includes a drill bit 110 that is operatively coupled to a tool string 150, which may be moved axially within the wellbore 101. During operation, the drill bit 110 penetrates the earth 102 and thereby creates the wellbore 101. BHA 120 provides directional control of the drill bit 110 as it advances into the earth 102. Tool string 150 can be semi-permanently mounted with various measurement tools (not shown) such as, but not limited to, MWD and LWD tools, that may be configured to take downhole measurements of drilling conditions and geological formation of the earth 102. The measurement tools can include sensors, such as magnetometers, accelerometers, gyroscope, etc.

The system 100 is configured to drive the BHA 120 positioned or otherwise arranged at the bottom of the drill string 125 extended into the earth 102 from a derrick 130 arranged at the surface 104. The system 100 includes a top drive 131 that is used to rotate the drill string 125 at the surface 104, which then rotates the drill bit 110 in the wellbore 101. Operation of the top drive 131 is controlled by a top drive controller. The system 100 can also include a kelly and a traveling block that is used to lower and raise the kelly and drill string 125.

Fluid or "drilling mud" from a mud tank 140 may be pumped downhole using a mud pump 142 powered by an adjacent power source, such as a prime mover or motor 144. The drilling mud may be pumped from mud tank 140, through a stand pipe 146, which feeds the drilling mud into drill string 125 and conveys the same to the drill bit 110. The drilling mud exits one or more nozzles arranged in the drill bit 110 and in the process cools the drill bit 110. After exiting the drill bit 110, the mud circulates back to the surface 104 via the annulus defined between the wellbore 101 and the drill string 125, and in the process, returns drill cuttings and debris to the surface. The cuttings and mud mixture are passed through a flow line 148 and are processed such that a cleaned mud is returned down hole through the stand pipe 146 once again.

The system 100 also includes a well site controller 160, and a computing system 164, which can be communicatively coupled to well site controller 160. Well site controller 160 includes a processor and a memory and is configured to direct operation of the system 100.

Well site controller 160 or computing system 164, can be utilized to communicate with downhole tools of the tool string 150, such as sending and receiving telemetry, data, drilling sensor data, instructions, and other information, including but not limited to collected or measured parameters, location within the borehole 101, and cuttings information. A communication channel may be established by using, for example, electrical signals or mud pulse telemetry for most of the length of the tool string 150 from the drill bit 110 to the controller 160.

The controller 160, or a separate computing device such as computing system 164 or a processor located with the BHA 120 or tool string 150, can be configured to perform one or more of the functions of a vibration analyzer as disclosed herein. For example, the controller 160, the computing system 164, or a combination thereof can be configured to determine adaptive models from drilling job data of the drilling job. The adaptive models can be used in future drilling operations for DOS. The current drilling job being performed by the system 100 can also use the vibration analysis to make dynamic changes to operating parameters for vibration mitigation. Step 280 of method 200 in FIG. 2 provides an example of such real time execution. Computing system 164 can be proximate well site controller 160 or be distant, such as in a cloud environment, a data center, a lab, or a corporate office. Computing system 164 can be a laptop, smartphone, personal digital assistant (PDA), server, desktop computer, cloud computing system, other computing systems, or a combination thereof, that are operable to perform the processes and methods described herein. Well site operators, engineers, and other personnel can send and receive data, instructions, measurements, and other information by various conventional means with computing system 164 or well site controller 160.

FIG. 2 illustrates a flow diagram of an example of a method 200 of executing a drilling operation carried out according to the principles of the disclosure. The method 200 represents a vibration centric approach when considering a new job design that allows for improved performance assessment and cost savings. The method 200 uses a dataset from at least one completed run of a drilling job to obtain vibration information for use with future drilling operations. An aggregated data set from multiple runs can also be used to generate fleet level analytics that can be used for one or more future drilling operations. Analytics from method 200 can be used to make real-time decisions to mitigate vibrations or estimate tool performance against a job design. At least some of the steps of the method 200 can be performed by a vibration analyzer as disclosed herein. The method 200 begins after a drilling job has been completed.

In step 210, drilling job data from a completed drilling job is collected. The drilling job data includes sensor data collected from downhole sensors during the drilling job. The sensor data can be raw data and the sensors can be, for example, magnetometers, accelerometers, gyroscopes, etc. The sensors can be used to collect data on, for example, tension, compression, bending moment, and torque in a drill string. A sensor or sensors can also be used to measure the speed of shaft rotations within a tool. The measured data can correspond to average values, a minimum value, a maximum value, or a combination thereof. The raw data can be average data, peak data, or a combination of both. Statistics from the raw data can also be obtained, such as stick slip data. Stick slip data can be determined by the revolutions per minute (RPM) Max minus RPM minimum divided by RPM average. The drilling job data can also include other post-run data, such as field data of the drilling job (e.g., surface data, surface drilling parameters used during the drilling job, RT, observations during the drilling run, etc.), formation information (e.g., geography data, geological information, time and/or depth sonic logs), tool information (e.g., BHA information, types of sensors, tool failure information, and maintenance information), job information (e.g., well plan information, operational information), and performance metrics (rate of penetration (ROP), dogleg severity (DLS), M/LWD log quality). Drilling job data from more than one completed drilling run can be collected and received.

In step 220, at least some of the collected data is processed. The sensor data can be processed to quantify vibrations measured during the drilling job. The vibration data can be quantified based on predetermined thresholds for amplitude and/or time. For example, a vibration severity index can be determined from the sensor data and can be based on an amplitude of the vibration being greater than an amplitude threshold or a duration of the vibration being greater than a time threshold. The vibration severity index can be determined by binning the sensor data based on frequencies, determining a magnitude for each bin, and calculating the vibration severity index based on an integral of each magnitude. FIG. 3 provides and example of a flow diagram for determining a vibration severity index.

Additionally, statistical information can be extracted from various sensor data. For example, statistical information such as moving average, standard deviation, first derivatives and moving average of derivatives can be determined for the various sensors. Threshold based aggregation/classification of vibrations can also be determined. Binning similar to that used to determine the vibration severity index can be used for classifying vibrations, wherein the classifications are selective aggregates that may be used only when certain thresholds are met. The classifications of vibration signatures can be derived from specific measurements of magnitude or on changes in magnitude. The classifying of vibration signatures can be determined from an analysis of the sensor data over a period of time or depth. An example is accelerometer peak/average data in X, Y, or Z direction based on physical or numerical understanding of different vibration modes. As such, vibration modes can also be identified from the sensor data based on frequency ranges of the vibrations.

For example, processed raw, sensor data is available over a period of time. Moving averages and standard deviations, therefore, can be calculated from the processed data and statistical metrics can also be used on the processed data to quantify vibrations. The threshold-based aggregation and classification is an example of the quantification.

In step 230, a data reservoir is created from at least some of the drilling job data and the processed data. The data reservoir can be a data lake that includes a combination of the drilling job data and the processed data, or at least some of the drilling job data and the processed data. The data reservoir allows combining the sensor data with related information from the drilling job to leverage the cause/effect correlation of vibrations for DOS. The data reservoir can be stored on a memory, such as a memory of the computing system 164. The data reservoir can include, for example: (1) Geography/Formation information, (2) BHA/Sensors/Well plan information, (3) Operational information, observations during drilling, (4) Surface Drilling parameters used during the drilling run, (5) Performance metrics (e.g., ROP, DLS, M/LWD log quality), (6) Extracted vibration indexes, (7) Vibration mechanism as function of time and depth, (8) Time/depth sonic logs and/or geological information, and (9) Tool failure and maintenance information.

A data set is generated in step 240 from the data reservoir. The data set can be generated by combining at least some of the drilling job data, the vibration severity index, and the vibration classifications signatures. The data set can also include, for example, job information, formation information, operational data, tool information, performance measurements, and custom logs for the drilling run. The data set can include one or more of a vibration mechanism index, vibration classification, BHA configuration, performance measurements, and custom logs that can be automatically generated. The custom logs can be predefined depending on BHA/drill string configurations and surface systems used for specific drilling operations. An example of a vibration mechanism index that is derived from the data reservoir is illustrated in FIG. 4.

The dataset can be generated for each drilling run and job level analytics can be performed for the particular drilling run. An aggregated data set from multiple drilling runs can be used to generate fleet level analytics. With a given set of input parameters, data slicing can be further accomplished to understand similarities and differences. For example, if a certain tool is used with a certain weight on bit (WOB) is there vibration?

In step 250, at least one adaptive model is extracted from the data set. The adaptive models can be used to determine the effectiveness of DOS for the drilling job and advise on future designs of well planning and execution. Multiple adaptive models can be extracted that are directed to different portions of a drilling job. For example, one of the adaptive models from the data set correlates the vibration signatures to particular components associated with the drilling job. The adaptive models, therefore, can relate vibration information to the drilling job. Other type of data or models may also be generated to improve analytics. For example, a model for bit-rock interaction can be generated that provides more granularity to vibration classifications. Different approaches can be used to obtain the adaptive models. For example, a rules based approach, machine learning, object code identification, or a combination thereof can be used to extract the adaptive models from the data set.

A rules based approach can be used to correlate certain vibration events to tool usage or drilling parameters. For machine learning, various supervised or unsupervised machine learning techniques can be used. For example, supervised machine learning techniques such as regression, random forest, or support vector machine can be used to drive decision making and create the adaptive models. Unsupervised machine learning techniques, such as various types of clustering, can be used to gain insights from the data set that are not obvious. Object code can be based on custom logs for each operation and used to identify patterns from the data set. The custom logs can be used to recognize a relationship between one or more vibrations and a specific parameter. For example, an identified vibration signature can be used to recognize other vibration signatures. Regardless the process, the data set is analyzed to derive rules and detect patterns for meaningful insights. Machine learning can be used to develop the custom logs from analysis of the data reservoir.

The adaptive models can also be generated based on initial models. As such, the initial models can be applied to the adaptive models in step 255. The initial models can be simple, rules-based models that are used to generate and or modify the adaptive models. The initial models can be heuristic based models developed by users. While these types of models can be useful, models developed from the data set by, for example, machine learning can advantageously determine possible vibration information and correlations that human developed heuristics might miss.

In step 260, correlation of vibration information and DOS for a drilling operation is performed based on at least one or more adaptive model. As a new job design is considered, a vibration centric approach using one or more of the models can be adopted when selecting, for example, a BHA configuration or drilling parameters to be used during the drilling job. A combination of information, such as vibration mechanism index, vibration severity, classification of vibration mode signatures, automatic custom logs, and job related information used to develop the adoptive models can be used for the correlation.

Using the one or more adaptive models for correlating can be accomplished in various ways. For example, vibration information can be correlated with different DOS aspects. Different correlations include: (1) BHA versus vibration, (2) Formation versus vibration, (3) Performance versus vibration, (4) Modes of vibration versus maintenance, and (5)

DOS plan versus execution. Based on the correlations, the adaptive models generated in step 250 can be further adapted.

In step 270, a DOS can be developed for a drilling operation based on one or more of the correlations from the at least one or more adaptive models. From the correlations, a DOS can be determined that is data driven and can allow for cost savings and better performance assessment. Potential vibration damage to drilling equipment can be prevented with a service design based on the correlations.

Additionally, the execution of at least a portion of the drilling operation is performed in step 280 based on the vibration analysis, such as one or more of the correlations from the at least one or more adaptive models. The analytics provided from the correlations can be used to make real-time decisions to mitigate vibrations or estimate tool performance against the design for the drilling operation. The correlations can be used to provide expected vibrations, recommend drilling parameters, steering advice (well path planning), estimation of tool life, and time/depth log of anticipated formation/BHA performance. The drilling operation can then be performed using, for example, the recommended drilling parameters, replacing or not replacing the drill bit based on the estimated life, steering the drill bit based on the steering advice, etc. Vibrations can be mitigated by changing operating parameters, such as the ROP, the WOB, the RPM, or a combination of one more of these or other operating parameters. Changing can be reducing or increasing and can be different for the various types of mitigations.

FIG. 3 illustrates a flow diagram of an example of a method 300 for determining a vibration severity index carried out according to the principles of the disclosure. The method 300 is directed to a single drilling job that has been completed but can be repeated for multiple drilling jobs. A computer system, such as computing system 164 or a computing system located downhole, can be used to perform at least some of the method 300. At least a portion of the method 300 can be performed downhole. The method 300 begins in step 310 with raw sensor data that is collected from downhole sensors during a drilling job. The sensor data can be high frequency data that is collected during a drilling run for downhole sensors, such as magnetometers, accelerometers, and gyroscopes. The sensor data can be sent in burst, such as at 1000 Hertz.

In step 320, the sensor data is processed to convert the raw data into discrete data. A Fast Fourier Transform (FFT) can be used. The sensor data can be continuously processed as it is received.

The processed data is then placed in bins in step 330. As such, raw sensor data is binned based on frequency. The processed data can represent a magnitude of an amplitude of the raw sensor data, wherein a dominant amplitude in frequency responses are identified. Each bin represents a frequency range and the number of bins can be predetermined based on, for example, historical data, or can be dynamically determined and adjusted based on the sensor data received. The bins correspond to different sensors and provide vibration information in particular directions based on the orientation of the sensors.

In step 340, a determination is made if a magnitude of each of the bins is greater than a threshold. The threshold can be established based on historical data and can be different for one or more of the bins. When greater than a threshold, the magnitude is logged. Thus, even though the raw sensor data can be continuously processed, not all of the magnitudes are saved. Accordingly, memory space, especially downhole, can be reduced.

An integral of the magnitudes for each of the bins is calculated in step 350. Conventional methods can be used to determine the integral. A vibration severity index is generated in step 360 based on the integral of magnitudes present in the bins. The integrals for each of the bins is used as an index value for the index.

At least a portion of methods 200 and 300 can represent an algorithm or algorithms and be encapsulated in software code or in hardware, for example, an application, a code library, a dynamic link library, a module, a function, a RAM, a ROM, and other software and hardware implementations. The software can be stored in a file, database, or other computing system storage mechanism. At least a portion of the methods 200 and 300 can be partially implemented in software and partially in hardware. A processor can be directed to perform operations according to the algorithms.

FIG. 4 illustrates an example of a vibration mechanism index 400 of a data set generated from a data reservoir according to the principles of the disclosure. The vibration mechanism index 400 is represented in a table having three columns for mechanism 410, mode of vibration 420, and expected frequency range 430. The types of vibration modes in column 420 can be determined by processing the sensor data obtained from a drilling job. For example, sensor data collected in step 210 of method 200 can be processed in step 220 to determine different types of modes of vibrations. Drilling job data collected in step 210, including the sensor data, can also be processed in step 220 to provide the expected frequency ranges of column 430. The mechanisms of the vibrations in column 1 can be determined from analysis of the data reservoir of step 230 and the resulting data set that is generated in step 240. Determining the vibration mechanisms of column 410 can be automatically determined by a processor. For example, sensor data can be analyzed and the different modes of vibration can be inferred from the frequencies and amplitudes, such as the dominant amplitudes. An analysis of a combination of data, such as steps 240 to 260 of method 200 on data collected in the data reservoir in step 230, can be performed to determine the vibration mechanisms. The logic for determining the vibration mechanisms can be integrated with a downhole tool to mitigate vibrations during a drilling operation by changing operating parameters.

Figure 5:
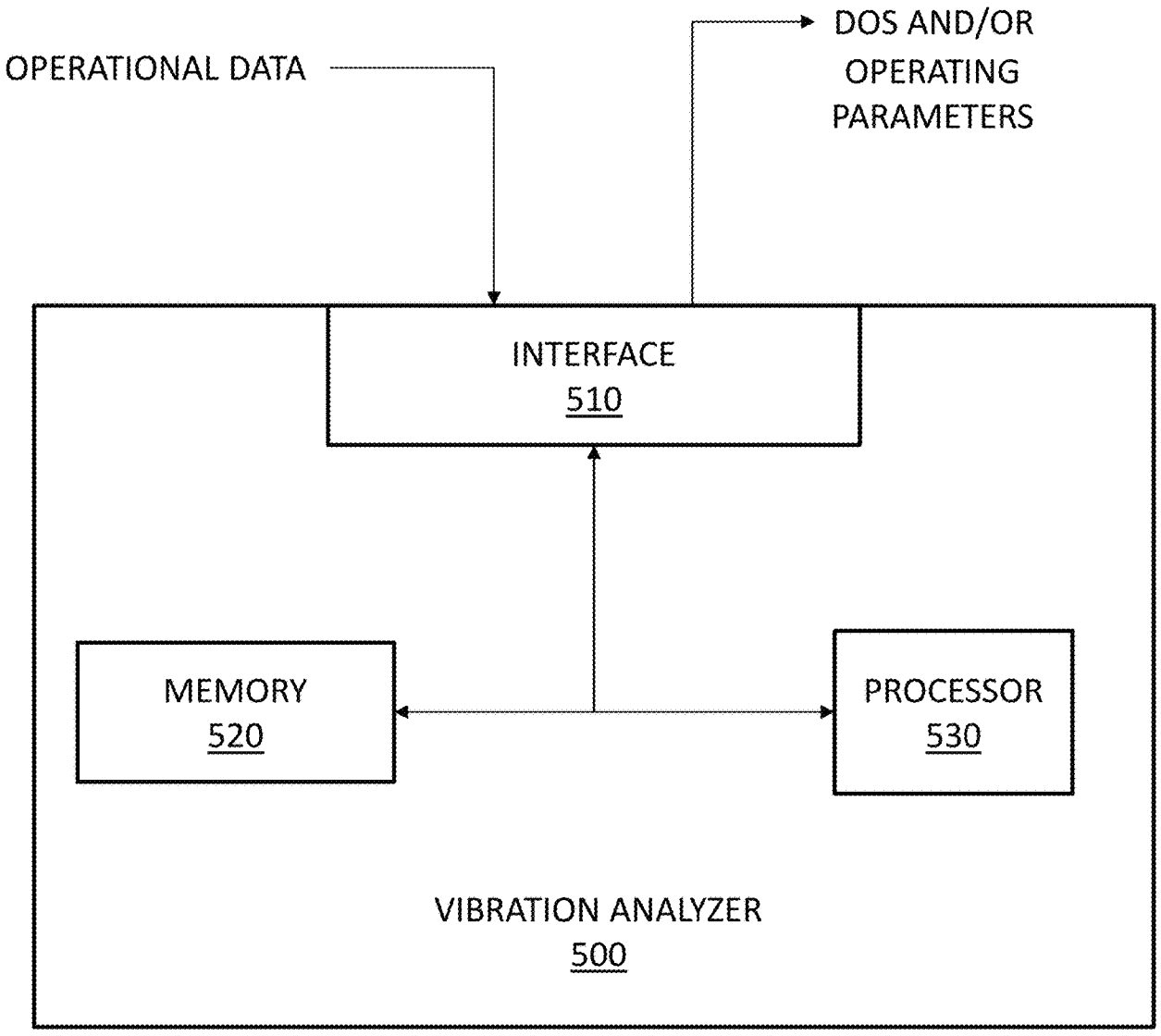
FIG. 5 illustrates a block diagram of an example of a vibration analyzer constructed according to the principles of the disclosure.

FIG. 5 illustrates a block diagram of an example of a vibration analyzer 500 constructed according to the principles of the disclosure. The vibration analyzer 500 can be implemented on a computing device or system that includes the necessary logic and memory to perform the functions disclosed herein, such as at least a portion of the methods 200 and 300. The vibration analyzer 500 can be implemented in a computing system at a well site and can be used to execute real-time changes in a drilling operation based on analyzing vibration information from the drilling operation. The vibration analyzer 500 can be integrated with downhole tools, such as part of a BHA, and direct a change of operating parameters based on the vibration analysis. A vibration analyzer 500 can also be implemented at a computing system at the surface of the drilling operation and dynamically change one or more operating parameters based on the vibration analysis. In some examples, the vibration analyzer 500 or at least a portion thereof can be implemented on a server.

The vibration analyzer 500 includes at least one interface, for example communications interface 510, at least one memory 520 (or data storage) that stores data and computer programs, and at least one processor 530 that performs functions when directed by the computer programs. The interface 510 is a component or device interface configured to communicate (transmit and receive) data. As illustrated, the interface 510 can receive drilling job data and output a DOS, a change in operating parameters, or both after analysis by the processor 530. The interface 510 can be a conventional interface that communicates data according to standard protocols. The memory 520 is configured to store a series of operating instructions that direct the operation of the processor 530 when initiated, including the code representing the algorithms for vibration analysis as disclosed herein, such as extracting adaptive models and correlating vibration information. The code can correspond to algorithms representing at least some of the steps of method 200 and method 300. The memory 520 can also store sensor data from a current drilling job. The memory 520 may also include a data reservoir, such as noted in FIG. 2. The memory 520 is a non-transitory computer readable medium. The memory 520 can be the memory of a server.

The processor 530 is configured to direct a drilling operation based on vibration information from one or more previous drilling jobs. As such, the processor 530 includes the necessary logic to communicate with the interface 510 and the memory 520 and perform the functions described herein to execute a drilling operation. For example, the processor 530 can analyze vibration information and based thereon generate a DOS. The processor 530 can also determine a change in operating parameters based on the vibration analysis. The processor 530 can be part of a server.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Configured means, for example, designed, constructed, or programmed, with the necessary logic and/or features for performing a task or tasks. A configured device, therefore, is capable of performing the task or tasks. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects disclosed in the SUMMARY can have one or more of the following additional elements in combination.

Element 1: further comprising classifying vibration signatures using the vibration severity index and the drilling job data. Element 2: further comprising generating a data set by combining at least some of the drilling job data, the vibration severity index, and the vibration signatures and extracting at least one adaptive model from the data set, wherein the executing at least a portion of the drilling operation includes using the adaptive models. Element 3: wherein the executing includes real-time adjustments based on correlations from the adaptive models. Element 4: wherein the extracting includes using machine learning to extract the at least one adaptive model from the data set. Element 5: wherein the at least one adaptive model from the data set correlates the vibration signatures to particular components associated with the drilling job. Element 6: wherein the executing uses the correlation between the vibration signatures to particular components for selecting a design of service for the drilling operation. Element 7: wherein determining the vibration severity index includes binning the sensor data based on frequencies, determining a magnitude for each bin, and calculating the vibration severity index based on an integral of each magnitude. Element 8: wherein the drilling job data further includes more than one of field data of the drilling job, formation information associated with the drilling job, tool information, job information, and performance metrics. Element 9: further comprising creating a data reservoir from the drilling job data and processed data from the sensor data, wherein the processed data includes the vibration severity index. Element 10: further comprising automatically generating a vibration mechanism index and generating a data set from the data reservoir that includes the vibration mechanism index. Element 11: wherein the at least one adaptive model from the data set correlates vibration signatures to particular components associated with the drilling job. Element 12: wherein the processor is configured to execute at least a part of the drilling operation in real time. Element 13: wherein the vibration information includes classification of vibration modes, a vibration severity index, and statistical metrics from the sensor data. Element 14: wherein the processor uses machine learning to extract the at least one adaptive model from the data set. Element 15: wherein the multiple downhole tools includes a drill bit and the processor is configured to direct operation of the drill bit by implementing a change of at least one of weight on bit, revolutions per minute, and rate or penetration based on the at least one adaptive model. Element 16: wherein the processor if further configured to generate a service design for the drilling operation based on the at least one adaptive model. Element 17: wherein the data set includes a vibration mechanism index that includes various vibration mechanisms for different modes of vibrations and a frequency range for the various vibration mechanisms and different modes of vibrations.

What is claimed is:

1. A method of executing a drilling operation, comprising:

collecting drilling job data from a completed drilling job, wherein the drilling job data includes sensor data collected from downhole sensors;

determining a vibration severity index from the sensor data, wherein the determining includes binning the sensor data based on frequencies and determining a magnitude for each bin;

executing a drilling operation that includes operating a drill bit;

identifying, using the vibration severity index, at least one component of the drilling operation causing vibration during the operating of the drill bit;

mitigating the vibration by adjusting at least one operating parameter of the component; and continuing the executing of the drilling operation after the mitigating.

2. The method as recited in claim 1, further comprising classifying vibration signatures using the vibration severity index and the drilling job data.

3. The method as recited in claim 2, further comprising generating a data set by combining at least some of the drilling job data, the vibration severity index, and the vibration signatures; and extracting at least one adaptive model from the data set and using the at least one adaptive model for the identifying and the mitigating.

4. The method as recited in claim 3, wherein the executing includes real-time adjustments based on correlations from the adaptive models.

5. The method as recited in claim 3, wherein the extracting includes using machine learning to extract the at least one adaptive model from the data set.

6. The method as recited in claim 3, wherein the at least one adaptive model from the data set correlates the vibration signatures to particular components associated with the drilling job.

7. The method as recited in claim 6, wherein the executing uses the correlation between the vibration signatures to the particular components for selecting a design of service for the drilling operation.

8. The method as recited in claim 1, wherein determining the vibration severity index further includes calculating the vibration severity index based on an integral of each magnitude.

9. The method as recited in claim 1, wherein the drilling job data further includes more than one of field data of the drilling job, formation information associated with the drilling job, tool information, job information, and performance metrics.

10. The method as recited in claim 9, further comprising creating a data reservoir from the drilling job data and processed data from the sensor data, wherein the processed data includes the vibration severity index.

11. The method as recited in claim 10, further comprising automatically generating a vibration mechanism index and generating a data set from the data reservoir that includes the vibration mechanism index.

12. A vibration analyzer, comprising:

a memory having drilling job data from at least one drilling job, wherein the drilling job data includes sensor data from the drilling job; and at least one processor configured to perform operations that include generating, from the sensor data, vibration information that includes a vibration severity index, generating a data set from a data lake of the drilling job data and the vibration information, extracting at least one adaptive model from the data set, executing a drilling operation, which includes operating a drill bit, using the at least one adaptive model, identifying, using the vibration severity index, at least one component of the drilling operation causing vibration during the operating of the drill bit, mitigating the vibration by adjusting at least one operating parameter of the component, and continuing the executing of the drilling operation after the mitigating.

13. The vibration analyzer as recited in claim 12, wherein the at least one adaptive model from the data set correlates vibration signatures to particular components associated with the drilling job, wherein the component is one of the particular components.

14. The vibration analyzer as recited in claim 12, wherein at least a part of operating the drill bit is in real time.

15. The vibration analyzer as recited in claim 12, wherein the vibration information further includes classification of the vibration modes and statistical metrics from the sensor data.

16. The vibration analyzer as recited in claim 12, wherein the processor uses machine learning for extracting the at least one adaptive model from the data set.

17. A drilling system, comprising:

multiple downhole tools; and a processor configured to direct a drilling operation for drilling into a formation using at least one adaptive model and at least one of the multiple downhole tools, identifying at least one component of the drilling operation causing vibration during the drilling operation using a vibration severity index, mitigating the vibration by adjusting at least one operating parameter of the component, and continuing the drilling operation after the mitigating, wherein the at least one adaptive model is extracted from a data set based on a data lake, wherein the data lake includes drilling job data from a completed drilling job and vibration information generated from the completed drilling job, wherein the vibration information includes the vibration severity index.

18. The drilling system as recited in claim 17, wherein the multiple downhole tools includes a drill bit and the at least one operating parameter is weight on bit, revolutions per minute, or rate or penetration.

19. The drilling system as recited in claim 17, wherein the processor is further configured to generate a service design for the drilling operation based on the at least one adaptive model.

20. The drilling system as recited in claim 17, wherein the at least one adaptive model from the data set correlates vibration signatures to particular components associated with the drilling job.

* * * * *